United States Patent [19]

Matsuyama et al.

[11] 4,396,273

[45] Aug. 2, 1983

[54] TRANSFER UNIT FOR ELECTROPHOTOGRAPHIC COPYING MACHINE

[75] Inventors: Takashi Matsuyama; Tadahiro Yasuda, both of Hachioji, Japan

[73] Assignee: Olympus Optical Company Ltd., Tokyo, Japan

[21] Appl. No.: 286,046

[22] Filed: Jul. 22, 1981

[30] Foreign Application Priority Data

Sep. 29, 1980 [JP] Japan ..... 55-139553

[51] Int. Cl.[3] ..... G03G 15/00

[52] U.S. Cl. ..... 355/3 TR; 355/14 TR; 355/3 CH; 355/14 CH; 430/33; 430/35; 118/620; 118/625; 118/638

[58] Field of Search ..... 355/3 TR, 3 DD, 3 SH, 355/14 D, 14 TR, 3 CH, 14 CH, 14 SH, 3 R; 430/33, 35; 118/620, 625, 638; 101/426

[56] References Cited

U.S. PATENT DOCUMENTS 4,159,172 6/1979 Tani et al. ..... 355/3 TR

*Primary Examiner*—A. C. Prescott

*Attorney, Agent, or Firm*—Weinstein & Sutton

[57] ABSTRACT

A transfer unit includes a pair of guide and field stabilizer members disposed adjacent to a transfer member and along a conveying path for a transfer sheet. A voltage is applied to the stabilizer members which is of the same polarity as a bias voltage applied to the transfer member. It is assured that transfer sheet reliably contacts the pair of field stabilizer members as it passes therebetween.

8 Claims, 8 Drawing Figures

TRANSFER UNIT FOR ELECTROPHOTOGRAPHIC COPYING MACHINE

BACKGROUND OF THE INVENTION

The invention relates to a transfer unit for an electrophotographic copying machine, and more particularly, to a transfer unit which transfers a toner image, formed by developing an electrostatic latent image developed by an exposure step, onto a transfer sheet.

Referring to FIG. 1, there is shown a conventional electrophotographic copying machine which is shown to define an original feed path to permit a copying from a single sheet-shaped original 1. The original is placed on an inclined original guide table 2, and is fed in a direction indicated by an arrow A into an inlet opening of an original feeder comprising pairs of conveying rollers 4A, 4B, 5A, 5B and guide plates 6, 7. The pair of vertically aligned conveying rollers 4A, 4B feeds the original 1 toward an exposure window 8 which is formed in the lower guide plate 7. During such movement, the original 1 passes between the both guide plates 6, 7. After passage through the exposure window 8, the original 1 is further conveyed by another pair of vertically aligned conveying rollers 5A, 5B to be delivered onto an original tray 9.

As the original 1 is fed by the original feeder, a pair of microswitches 3A, 3B located on the opposite sides of the conveying roller 4A detect the position of the original 1 to provide an output, which is utilized to control the timing of operation of various parts of the electrophotographic copying machine. As the original 1 passes through the exposure window 8, an illumination lamp 10 illuminates the surface of the original, whereby the image of the original is projected by an optics 11 onto a photosensitive drum 12. The drum 12 is adapted to rotate in a direction indicated by an arrow B, and is uniformly charged by a corona charger 14 after any residual charge has been removed by a neutralizer lamp 13. Subsequently, the drum surface is subject to an irradiation with the optical image of the original, thereby forming an electrostatic latent image thereon. The latent image is then developed with a toner by a developing unit 15 of dry type, and as the drum 12 continues to rotate, the toner image is carried into a transfer station 16.

A number of transfer sheets 18 are stored in a stack in a cassette 17 and are fed one by one by an oscillating and rotating feed roller 19, and a pair of vertically aligned register rollers 20 controls the timing to feed the sheet into the transfer station 16. In the transfer station 16, the transfer sheet 18 is fed into the nip between the drum 12 and transfer member 21 or a transfer roller to which a bias voltage is applied so as to be brought into overlapping relationship with the toner image on the drum, thus effecting a transfer of the toner image. Since the transfer sheet is conveyed in close contact with the drum 12 during such process, it is separated from the drum by the combined action of a separating claw 22 and an airstream to be described later. After the transfer step, the transfer sheet having the toner image transferred thereto is conveyed by a pair of vertically aligned conveying rollers 24 to move along a guide 23 and through a heat fixing unit 25 which includes heaters where the toner image is fixed by melting. Subsequently, the sheet is conveyed by another pair of vertically aligned delivery rollers 26 onto a copy tray 27.

Any residual toner which remains on the drum 12 without being transferred to the transfer sheet is swept off by a rotating cleaning brush 28 and is withdrawn by an airstream created by a fan 29 to be trapped by a filter 30. The cleaning brush 28, the fan 29 and the filter 30 are enclosed within a casing 31 in order to obtain an effective displacement of the residual toner and to prevent a dispersion of the toner into the machine. The airstream discharged by the fan 29 is introduced into a duct 32 having its outlet **32*a* located adjacent to the transfer station 16 so as to cooperate with the separating claw 22 to separate effectively the transfer sheet from the drum 12**.

During the transfer step of the copying machine described above, the transfer sheet 18 is positively charged by the transfer roller 21 to which a bias voltage E is applied, as shown in FIG. 2, whereby the toner having a negative charge and deposited on the latent image formed on the drum 12 is attracted and migrates to the surface of the transfer sheet 18 as it is held between the drum 12 and the transfer roller 21, thus transferring the toner image onto the transfer sheet.

However, it is well recognized that the transfer quality is greatly degraded under high humidity conditions since the transfer sheet absorbs humidity to have its resistivity reduced. As the resistivity of the transfer sheet is reduced, the charge migrates in a direction of the plane of the transfer sheet 18, or in a direction perpendicular to the thickness thereof, as shown in FIG. 3, whereby it may leak through a metal roller 20 or the like which is used to guide the path of the transfer sheet, resulting in a failure to develop a transfer field.

As an approach to avoid such difficulty, there is proposed the isolation from the ground of a conveying path which is contacted by the transfer sheet during the time the transfer bias is applied to the transfer sheet, thereby preventing a leakage of the charge. However, if the transfer sheet used has an increased size, the isolation must cover an increased number of parts, resulting in an expensive arrangement.

Another approach has been proposed as shown in FIG. 4 where a pair of guide plates 40 are disposed close to the transfer roller 21 so as to delineate the upper and lower limit of the conveying path for the transfer sheet 18. An auxiliary bias voltage $E_0$ of the same polarity as the bias voltage E applied to the transfer roller 21 is applied to the both guide plates 40 in order to avoid a leakage of the transfer charge therethrough. FIG. 5 shows an alternative approach in which the pair of guide plates 40 is replaced by a pair of conveying rollers 41 to which the bias voltage $E_0$ is again applied.

However, the arrangement of FIG. 4 suffers from the disadvantage that the transfer sheet 18 passing between the pair of guide plates 40 may not contact the latter in a reliable manner. In the arrangement of FIG. 5, the contact between the rollers 41 and the transfer sheet 18 is assured, but it is necessary to provide a drive mechanism for these rollers, resulting in a complex arrangement.

SUMMARY OF THE INVENTION

It is an object of the invention to overcome the above disadvantages of the prior art, by providing a transfer unit for an electrophotographic copying machine including a pair of guide and field stabilizer members disposed on the opposite sides of a conveying path for a transfer sheet and to which a voltage of the same polarity as the bias voltage applied to a transfer member is applied, thereby assuring a contact of the transfer sheet with these members as it passes therebetween.

In accordance with the invention, a reliable contact of the transfer sheet with the pair of guide and field stabilizer members is assured, whereby the charge on the transfer sheet cannot find its way for leakage even if the resistivity of the transfer sheet is reduced under high humidity conditions. Since the stabilizer members also serve as guide members for the transfer sheet, the latter is positively guided along a given conveying path.

DESCRIPTION OF PREFERRED EMBODIMENT

Figure 1:
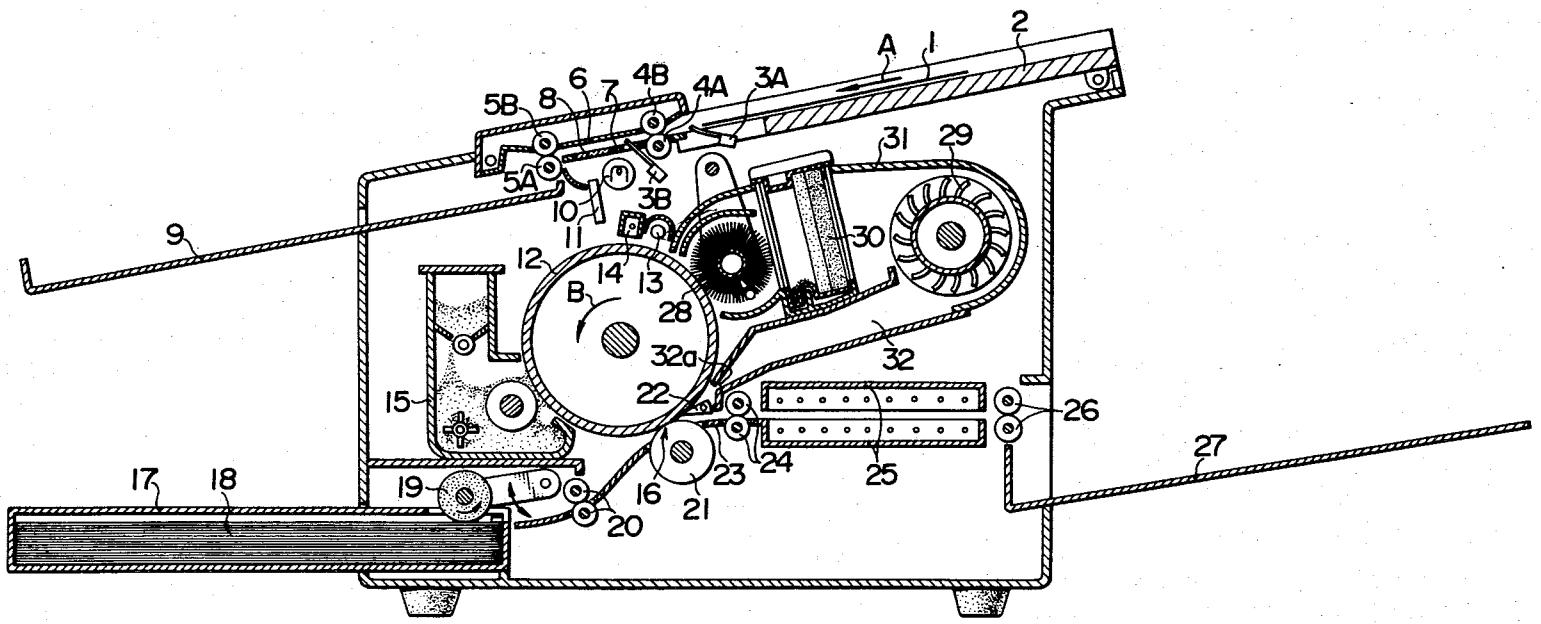
FIG. 1 is a schematic cross section of one form of an electrophotographic copying machine to which the invention may be applied.
Figure 2:
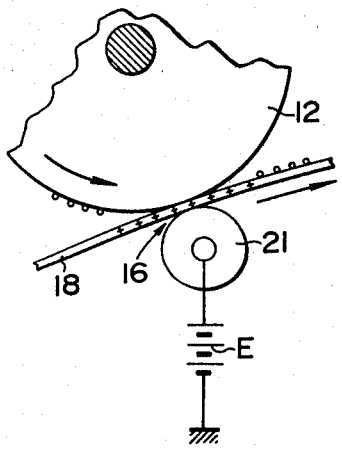
FIG. 2 is a schematic side elevation of the transfer station, illustrating the charge condition during a transfer operation of the machine.
Figure 4:
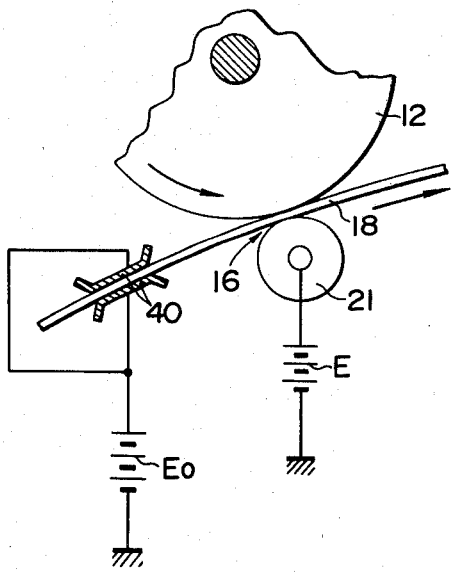
FIG. 4 (PRIOR ART)
FIGS. 4 and 5 are schematic cross sections illustrating conventional transfer units.
Figure 3:
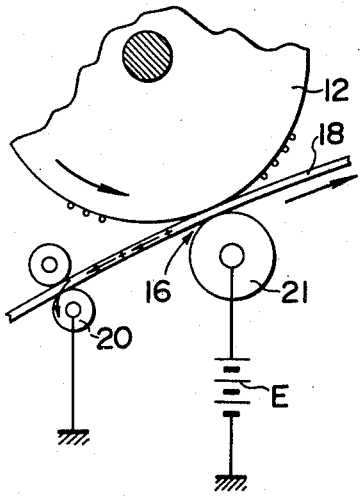
FIG. 3 is a similar side elevation of the transfer station under high humidity condition.
Figure 5:
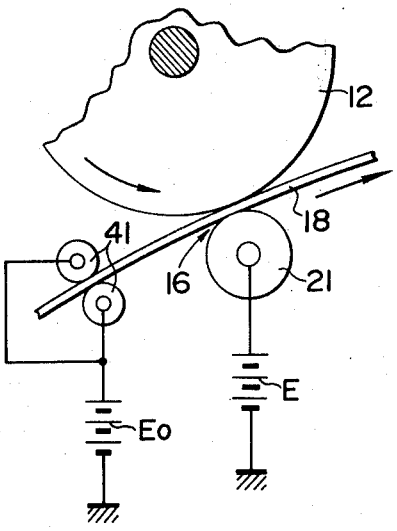
FIG. 5 (PRIOR ART)
Figure 6:
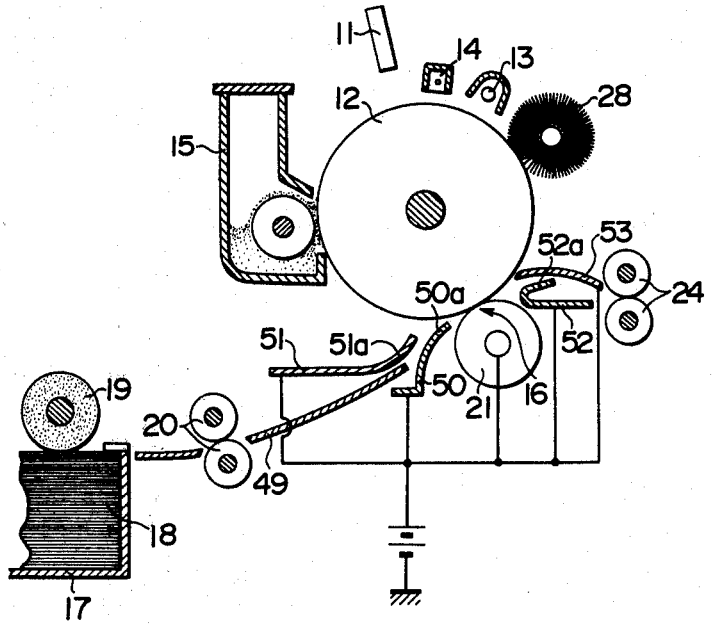
FIG. 6 is a schematic cross section of an electrophotographic copying machine including a transfer unit according to one embodiment of the invention.

FIG. 6 is a schematic cross section of an electrophotographic copying machine including a transfer unit constructed according to one embodiment of the invention. In FIG. 6, components corresponding to those shown in FIG. 1 are designated by like numerals without repeating their description.

In FIG. 6, a first guide and field stabilizer member 50 formed of a metal material and having an extension 50*a* which is arcuate in cross section is disposed along a conveying path for the transfer sheet 18 at a location on the left-hand side and in the vicinity of the transfer roller 21. A second field stabilizer member 51 having an extension 51*a* which is arcuate in cross section is disposed in opposing relationship with the first member 50 so that the extension 51*a* is located opposite to the extension 50*a* on the opposite side of the path. A guide plate 49 has its one end extending into the gap between the pair of field stabilizer members 50, 51 for conveying the transfer sheet 18 therealong.

A third field stabilizer member 52 is disposed on the right-hand side and in the vicinity of the transfer roller 21 along a conveying path of the transfer sheet 18. The third member 52 is formed by a metal guide plate which is V-shaped in cross section, with the opening of the V directed to the right so as to be disposed horizontally. The third member 52 has an upper extension or limb 52*a* which extends into the conveying path. A fourth field stabilizer member 53 formed by a metal guide plate which is arcuate in cross section is disposed above and in the vicinity of the third member 52, with its concave side located downside toward the extension 52*a* of the third member 52. The left-hand end of the fourth field stabilizer member 53 is disposed almost in contact with the drum surface so as to serve as the separating claw 22 shown in FIG. 1. The right-hand end of the fourth member 53 extends close to the conveying roller 24 in order to cooperate with the third member 52 to guide the transfer sheet into the nip between the rollers 24. A voltage E which is equal to the bias voltage applied to the transfer roller 21 is applied to each of the first to the fourth field stabilizer members 50 to 53.

In operation, as the transfer sheet 18 is fed by the feed roller 19 and register rollers 20 to move along the guide plate 49, its leading end initially moves into contact with the first field stabilizer member 50. As it further advances, the upper surface of the transfer sheet 18 moves into contact with the lower surface of the second field stabilizer member 51. As it continues to advance, the transfer sheet moves forward while being held between the transfer roller 21 and the drum 12, during which time the toner image is transferred from the drum 12 to the transfer sheet 18. Subsequently, as the transfer sheet 18 moves forward between the drum 12 and the transfer roller 21, it is separated from the drum 12 by the action of the left-hand end of the fourth field stabilizer member 53 to be turned down and to the right toward the conveying rollers 24 while gently contacting the fourth member 53. As the transfer sheet moves to the right and downwardly, it also contacts the third field stabilizer member 52. In this manner, during its passage through the transfer station 16, the transfer sheet 18 continues to move while contacting the field stabilizer members 50 to 53 successively. Accordingly, if the resistivity of the transfer sheet 18 is reduced under high humidity condition, a leakage of the charge which establishes the transfer field is prevented since these members 50 to 53 are maintained at the same potential as the transfer roller 21. The transfer sheet 18 is finally conveyed by the rollers 24 out of the transfer station into a heat fixing unit.

Figure 7:
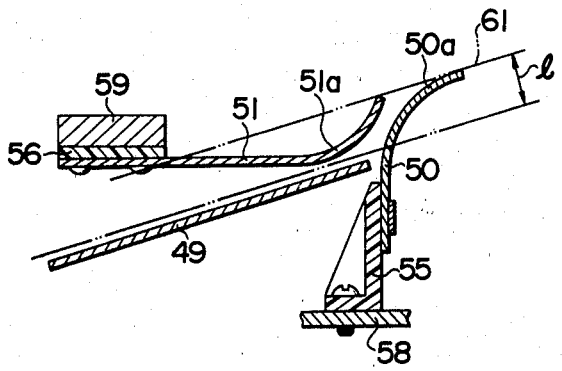
FIGS. 7 and 8 are enlarged cross sections, illustrating the disposition of field stabilizer members used in the transfer unit of FIG. 6.
Figure 8:
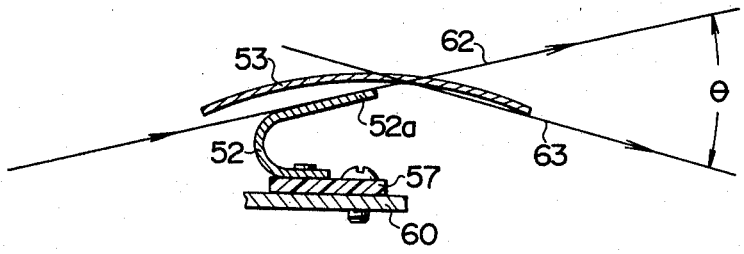

FIGS. 7 and 8 show the relative position between the first and the second field stabilizer member 50, 51 and between the third and the fourth field stabilizer member 52, 53 in detail. Specifically, the first to the third field stabilizer member 50, 51 and 52 are secured to suitable brackets 58, 59 and 60, respectively, mounted on the machine by means of set screws, with insulating members 55, 56, 57, respectively, interposed therebetween. The fourth member 53 is similarly secured though specific means is not illustrated.

As shown in FIG. 7, the arcuate extension 50*a* of the first member 50 is shaped so that a tangent 61, shown in phantom line, to the upper end thereof extends generally parallel to the plane of the guide plate 49, and is spaced therefrom by a distance l. The second field stabilizer member 51 is disposed so that its arcuate extension 51*a* is located close to the first member 50 and within the confines defined by the tangent 61 and the plane of the guide plate. As a result of such arrangement, it is assured that the transfer sheet 18 which is fed along the guide plate 49 reliably contacts both the first and the second members 50, 51.

As shown in FIG. 8, the third field stabilizer member 52 is disposed so that its upper extension 52*a* is embraced by the curvature of the fourth field stabilizer member 53 and lies in a plane 62 along which the transfer sheet 18 is conveyed and which forms a given angle $\theta$ with a direction 63 into which the transfer sheet is finally diverted by the curvature of the fourth member 53. As a result of such arrangement, it is again assured that the transfer sheet 18 passing between these members reliably contacts both the third and the fourth field stabilizer members 52, 53.

What is claimed is:

1. A transfer unit for an electrophotographic copying machine including field stabilizer means disposed adjacent to a transfer member and having a voltage applied thereto which is of the same polarity as a bias voltage applied to the transfer member, the field stabilizer means comprising a first field stabilizer member having an extension which extends into a conveying path for a transfer sheet, the extension guiding the transfer sheet to pass along the conveying path while causing the sheet to bear smoothly against the extension, and a second field stabilizer member disposed adjacent to the first field stabilizer member and on the opposite side of the conveying path from the first member, the second member urging the transfer sheet into contact with the extension of the first member as the transfer sheet passes through the conveying path.

2. A transfer unit according to claim 1 in which the first field stabilizer member is formed by a metal guide plate, the extension of which is arcuate in cross section and extends into the conveying path, the second field stabilizer member being formed by a metal guide plate having an extension which is arcuate in cross section.

3. A transfer unit according to claim 2, further including a guide plate which guides the transfer sheet along the conveying path and into the space between the first and the second member, the arcuate extension of the first member being shaped such that a tangent to the upper end thereof extends substantially parallel to the plane of the guide plate, the arcuate extension of the second field stabilizer member being disposed above the guide plate and within the confines defined by the tangent and the plane of the guide plate with its concave side directed upward.

4. A transfer unit according to claim 1 in which the first field stabilizer member is formed by a metal guide plate which is V-shaped in cross section, with the opening of the V oriented horizontally in the conveying direction of the transfer sheet, the first member having an upper extension which is disposed in the conveying path, and in which the second field stabilizer member is formed by a metal guide plate which is partly arcuate in cross section and which is disposed above and in the vicinity of the extension of the first member, with its concave side oriented downside.

5. A transfer unit according to claim 4 in which the both field stabilizer members are disposed so that a given acute angle is defined between the direction in which the transfer sheet is conveyed by the extension of the first member and the direction into which the transfer sheet is diverted by the arcuate portion of the second member.

6. A transfer unit according to claim 4 in which one end of the second field stabilizer member extends close to the peripheral surface of a photosensitive drum almost in contact therewith, thereby serving as a claw for separating the transfer sheet from the drum.

7. A transfer unit for an electrophotographic copying machine including field stabilizer means disposed adjacent to a transfer member, said field stabilizer means having a voltage applied thereto which is of the same polarity as a bias voltage applied to said transfer member, said transfer member having an input feed side and an output feed side, said field stabilizer means being disposed on said input feed side of said transfer member, said field stabilizer means comprising a first field stabilizer member having an extension which extends into a conveying path for a transfer sheet for guiding the transfer sheet to pass along the conveying path while causing the sheet to bear against said extension, and a second field stabilizer member disposed adjacent to said first field stabilizer member and on the opposite side of the conveying path from said first member, said second member urging said transfer sheet into contact with said extension of said first member as said transfer sheet passes through said conveying path.

8. A transfer unit for an electrophotographic copying machine including field stabilizer means disposed adjacent to a transfer member, said field stabilizer means having a voltage applied thereto which is of the same polarity as a bias voltage applied to said transfer member, said transfer member having an input feed side and an output feed side, said field stabilizer means being disposed on said output feed side of said transfer member, said field stabilizer means comprising a first field stabilizer member having an extension which extends into a conveying path for a transfer sheet for guiding the transfer sheet to pass along the conveying path while causing the sheet to bear against said extension, and a second field stabilizer member disposed adjacent to said first field stabilizer member and on the opposite side of the conveying path from said first member, said second member urging said transfer sheet into contact with said extension of said first member as said transfer sheet passes through said conveying path.

* * * * *